US005572860A

United States Patent [19]

Mitsumoto et al.

[11] Patent Number: 5,572,860

[45] Date of Patent: Nov. 12, 1996

[54] FUSIBLE ADHESIVE YARN

[75] Inventors: Shigenobu Mitsumoto, Wakayama; Takeo Okumoto, Osaka, both of Japan

[73] Assignees: Nitto Boseki Co., Ltd.; Shima Seiki Co., Ltd., both of Japan

[21] Appl. No.: 386,129

[22] Filed: Feb. 7, 1995

Related U.S. Application Data

[63] Continuation of Ser. No. 221,998, Apr. 4, 1994, abandoned, which is a continuation of Ser. No. 948,427, Sep. 22, 1991, abandoned.

[30] Foreign Application Priority Data

Dec. 11, 1991 [JP] Japan ..... 3-109547 U

[51] Int. Cl.[6] ..... D02G 3/02; D02G 3/06

[52] U.S. Cl. ..... 57/224; 57/210; 57/225; 57/226; 57/230; 57/231

[58] Field of Search ..... 51/210, 224, 225, 51/226, 230, 234

[56] References Cited

U.S. PATENT DOCUMENTS

| | | | |
|---|---|---|---|
| 1,766,776 | 6/1930 | Chisholm | 57/225 |
| 2,076,273 | 4/1937 | Harris | 57/225 |
| 2,281,647 | 5/1942 | Whitehead | 57/234 X |
| 2,588,361 | 3/1952 | Cooper | 57/225 |
| 3,460,338 | 8/1969 | Morrison | 57/225 X |
| 3,487,628 | 1/1970 | Csok . | |
| 3,831,369 | 8/1974 | Northup et al. | 57/225 |
| 3,921,382 | 11/1975 | Tsujita et al. . | |
| 4,299,884 | 11/1981 | Payen | 57/210 X |
| 4,840,021 | 6/1989 | Guevel et al. | 57/210 |
| 5,010,723 | 4/1991 | Wilen | 57/210 |

FOREIGN PATENT DOCUMENTS

| | | | |
|---|---|---|---|
| 161148 | 6/1991 | China . | |
| 161149 | 6/1991 | China . | |
| 0069878 | 10/1983 | European Pat. Off. . | |
| 385024 | 9/1990 | European Pat. Off. | 57/210 |
| 60-156189 | 10/1985 | Japan . | |
| 1246433 | 10/1989 | Japan | 57/210 |
| 241430 | 2/1990 | Japan . | |
| 75202375 | 2/1985 | Taiwan . | |
| 461931 | 2/1937 | United Kingdom . | |
| 2223245 | 4/1992 | United Kingdom . | |

OTHER PUBLICATIONS

Report of the National Science Committee of the Republic of China entitled "Ring Spinning". Jul. 31, 1992.

Taiwan Spinning Process Society, vol. 9, No. 1, 1991 "Hollow Spindle". pp. 124–127 of an unknown document which appears to have been published in Jan. 1982.

*Primary Examiner*—William Stryjewski

*Attorney, Agent, or Firm*—Sixbey, Friedman, Leedom & Ferguson, P.C.; Gerald J. Ferguson, Jr.; David S. Safran

[57] ABSTRACT

Fusible adhesive yarn in which spun core yarn and heat fusible yarn are twisted with each other in the same or opposite twisting direction as or to that of the spun core yarn. The spun core yarn is composed of elastic yarn and non-elastic short fiber assembly extending in the direction of the elastic yarn so that the non-elastic short fiber assembly encloses the circumference of the elastic yarn as a core.

7 Claims, 4 Drawing Sheets

FUSIBLE ADHESIVE YARN

This application is a continuation of Ser. No. 08/221,998, filed Apr. 4, 1994, now abandoned which was a continuation of Ser. No. 07/948,427, filed Sep. 22, 1991, abandoned.

BACKGROUND OF THE INVENTION

The present invention relates to fusible adhesive yarn, particularly relates to fusible adhesive yarn used for preventing fraying in knitting fabric at its knitting end portion, its edge portion, or the like.

Conventionally, various methods were carried out for preventing fraying from occurring at a knitting end portion of a fabric. As ore of the methods, there has been proposed a stitching method with the use of a linking machine. In carrying out such a stitching method by using the linking machine, however, it is necessary to manually pick up stitches one by one with a needle, and the working efficiency was therefore very poor, while the linked stitches is closed beautifully.

Accordingly, there has been used a method in which fusible adhesive yarn which may be thermally fused and solidified at an ordinary temperature is knitted into knitting fabric in the last several courses of the knitting, and then the fusible adhesive yarn is thermally fused so that contact points of loops of in-fusible yarn are fixed by the fused fusible adhesive yarn to thereby improve the working efficiency.

As shown in FIG. 5, such fusible adhesive yarn 50 is composed as the following manner: Heat fusible yarn which may be fused by heating and solidified at an ordinary temperature is twisted around the circumference of a single core material 51. For example, M/C, 1/20 Z-twisted 1000 T/M acrylic 100% yarn is dyed, two strings of the thus dyed yarn are subjected to 600 T/M S-twisting with 210 D poly-urethane elastic yarn, and the thus twisted yarn is further subjected to 400 T/M Z-twisting with separately prepared 100 D heat fusible yarn to thereby obtain fusible adhesive yarn. In this manner, in the conventional fusible adhesive yarn 50, after the dyed yarn 52 and the poly-urethane elastic yarn 53 are twisted together to provide core material, the twisted core material is further twisted with the heat fusible yarn. In spite of the fact that the twisting direction is changed from Z to S and from S to Z again, the fibers constituting the core material 51 are not so dis-twisted. Therefore, when the heat fusible yarn is fused by thermally setting, the finally twisted heat fusible yarn does not enter into the inside of the fibers by the fastening due to contraction of the elastic yarn 53, resulting in that the heat fusible yarn remains as lumps 54 on the surface of the yarn to deteriorate the feeling or touch in use of the knitting fabric. The heat fuse-adhesive force of the thus prepared yarn is 215 g. Here, the heat fuse-adhesive force is expressed by the strength applied to the yarn till the yarn is frayed or broken when the yarn is pulled at its one end after the yarn is subjected to thermal setting.

The heat fuse-adhesive force at a part of the yarn subjected to the above treatment increases with the increase of the contents of the heat fusible yarn, but the deterioration in the feeling cannot be avoidable correspondingly.

SUMMARY OF THE INVENTION

It is therefore an object of the present invention to provide fray-preventing fusible adhesive yarn which is superior in feeling and touch, and which is large in thermal fuse-adhesive force.

In order to attain the above object, the present invention provides fusible adhesive yarn in which spun core yarn and heat fusible yarn are twisted with each other in the same or opposite twisting direction as or to that of the spun core yarn, the spun core yarn being composed of elastic yarn and non-elastic short fiber assembly extending in the direction of the elastic yarn so that the non-elastic short fiber assembly encloses the circumference of the elastic yarn as a core.

The fusible adhesive yarn according to the present invention is in a state that spun core yarn composed of elastic yarn and non-elastic short fiber assembly enclosing the circumference of the elastic yarn as a core is twisted with heat fusible yarn. Since the elastic yarn is fed in the condition that it is forcibly extended till the end of knitting, the elastic yarn will lengthwise contract when the elastic yarn is released from the tensile force applied thereto after completion of knitting. Accordingly, looseness is caused in the non-elastic short fiber assembly enclosing the circumference of the elastic yarn so that air gaps are generated between the non-elastic short-fiber assemblies of adjacent yarn portions twisted with each other.

If the knitting fabric is subjected to thermal treatment in this condition, the fused heat fusible yarn enters into the short fibers to make the yarn portions thick at that position or to integrate the yarn portions constituting adjacent loops with each other in the loops of the knitted fabric. The fused portions of the fused yarn existing at the portion where the yarn is made thicker are covered by expanded short fibers, so that the feeling, the touch or the like cannot be deteriorated.

BRIEF DESCRIPTION OF THE DRAWINGS

Other features and advantages of the present invention will be apparent from the following description taken in connection with the accompanying drawings, wherein.

DETAILED DESCRIPTION OF THE PREFERRED EMBODIMENTS

The present invention will be described more in detail with respect to preferred embodiments hereunder.

Figure 1A:
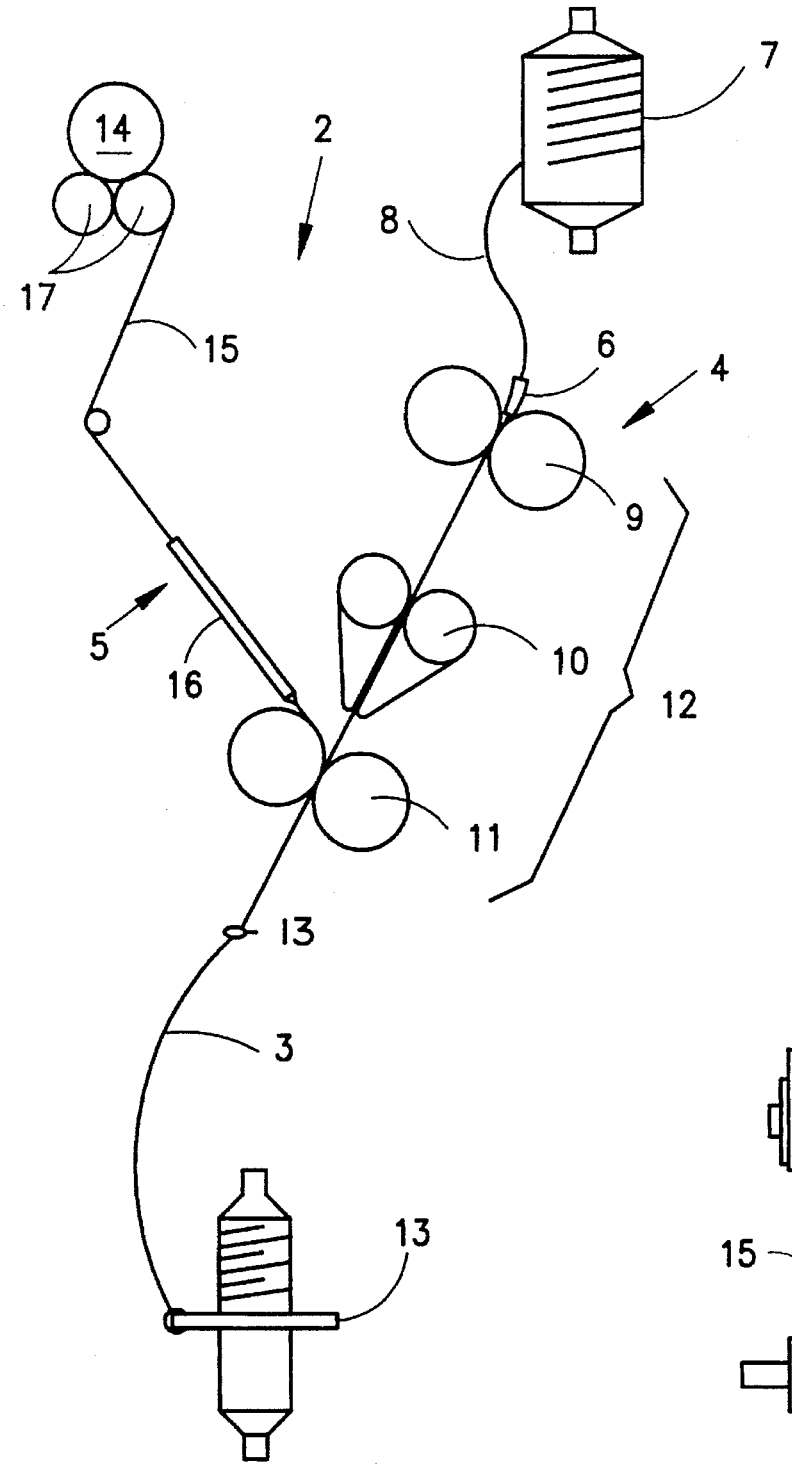
FIG. 1 is a schematic side view showing an apparatus for manufacturing spun core yarn according to a first embodiment of the present invention.
FIG. 1B is a plan view of a front roller pair portion of the apparatus of FIG. 1A.
Figure 1B:
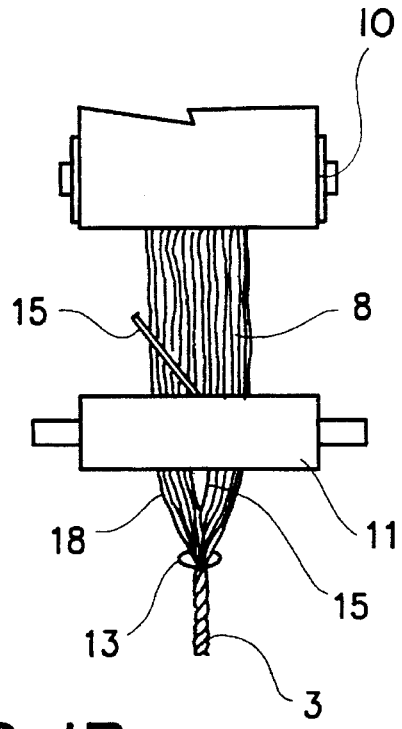

FIGS. 1A and 1B show an example of the apparatus for manufacturing the yarn according to the present invention.

Hereunder, a first embodiment of the fusible adhesive yarn 1 (FIG. 3A) according to the present invention will be described.

In the first embodiment, the fusible adhesive yarn 1 according to the present invention can be obtained by twisting a spun core yarn 3 prepared by a spun core yarn manufacturing apparatus 2 shown in FIG. 1A. The spun core yarn manufacturing apparatus 2 is constituted by an ordinary spinning device 4 and an elastic yarn feed device 5. The ordinary spinning device 4 is constituted by a draft part 12 and a ring twisting portion 13. The draft part 12 is constituted by a pair of back rollers 9, a pair of middle rollers 10 and a pair of front rollers 11 which rollers pairs 9, 10 and 11 are provided along a passage of roving or slubbing 8 guided from a roving bobbin 7 through a trumpet 6. The elastic yarn feed device 5 is provided with a tubular guide 16 for guiding elastic yarn 15 drawn out from an elastic yarn package 14 and, if necessary, a tension adjustment device (not shown). The elastic yarn package 14 is mounted on a pair of rollers 17 so that the yarn feed speed is regulated.

The spun core yarn 3 is manufactured by the spun core yarn manufacturing apparatus 2.

The roving 8 drawn out from the roving bobbin 7 is led to the back roller pair 9 through the trumpet 6 and drafted through the draft part 12, and in drafting, the elastic yarn 15 is fed into the upstream side of the front roller pair 11 through the tubular guide 16 opened toward this side. At this time, tension is properly applied to the elastic yarn 15 through the rotation control of the roller pair 17 or by means of the not-shown tension adjustment device, so that, as shown in FIG. 1B, the elastic yarn 15 in the extended state is fed into the central position of the roving 8 which has been drafted so as to be belt-like. The roving 8 and the elastic yarn 15 coming out of the front roller pair 11 are twisted by the ring twisting portion 13 so as to form the spun core yarn 3 in which a short fiber assembly 18 which has constituted the roving 8 encloses the circumference of the elastic yarn 15 as a core.

Figure 3A:
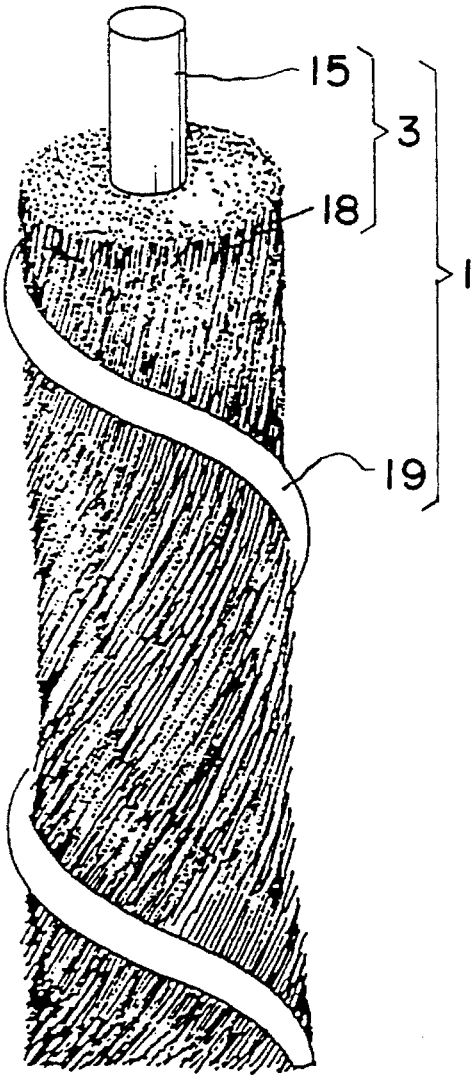
FIG. 3A is a front view showing fusible adhesive yarn before heating according to the first embodiment.
Figure 3B:
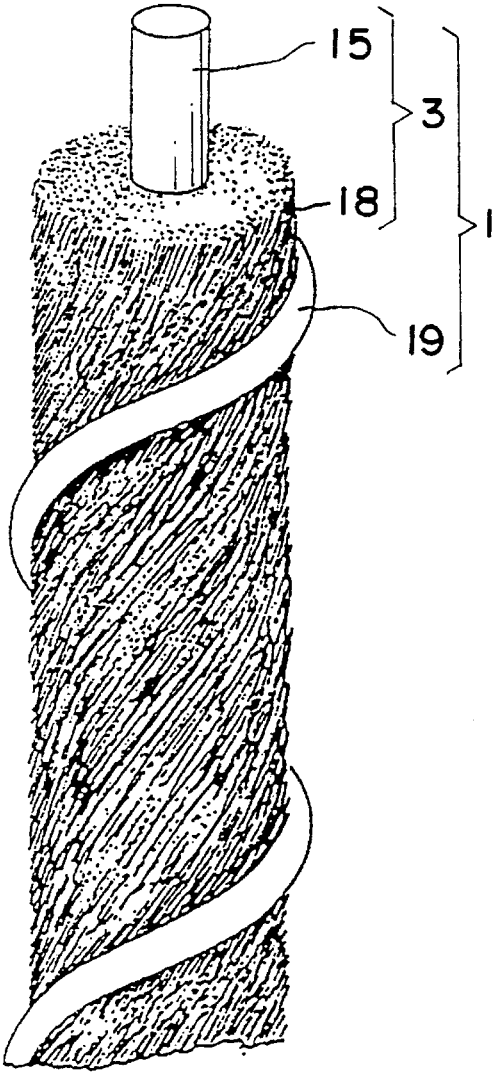
FIG. 3B is a front view showing fusible adhesive yarn before heating according to the second embodiment.

The thus prepared spun core yarn 3 is twisted with separately prepared heat fusible yarn 19 in the twisting direction opposite to the preceding twisting direction so as to obtain the fusible adhesive yarn 1 in which the heat fusible yarn 19 is wound at intervals on the spun core yarn 3 as shown in FIG. 3A.

A specific example of the fusible adhesive yarn in this embodiment will be described under.

M/C, 1/12 spun core yarn having 700 T/M Z-twisting was prepared by using 3 D, average fiber length 105 m/m, 100% acrylic dyed staple fiber as a short fiber assembly of the sheath portion, and 210 D poly-urethane elastic yarn as core yarn, and the thus prepared spun core yarn and 100 D polyamide multi-filament heat fusible yarn were twisted with each other at 400 T/M in the S-direction to thereby prepare the fusible adhesive yarn according to the present invention. The fuse-adhesive force of the thus prepared yarn was 352 g and was sufficient to show the effect in preventing fraying from occurring.

A second embodiment of the fusible adhesive yarn 1 according to the present invention will be described hereunder. The fusible adhesive yarn in this second embodiment is different from that in the first embodiment in the point that the fusible adhesive yarn in this second embodiment is obtained in such a manner that heat fusible yarn is wound on the surface of core yarn when the core yarn is formed while the fusible adhesive yarn in the first embodiment is obtained in such a manner that the core yarn 3 and the heat fusible yarn are twisted with each other.

Figure 2A:
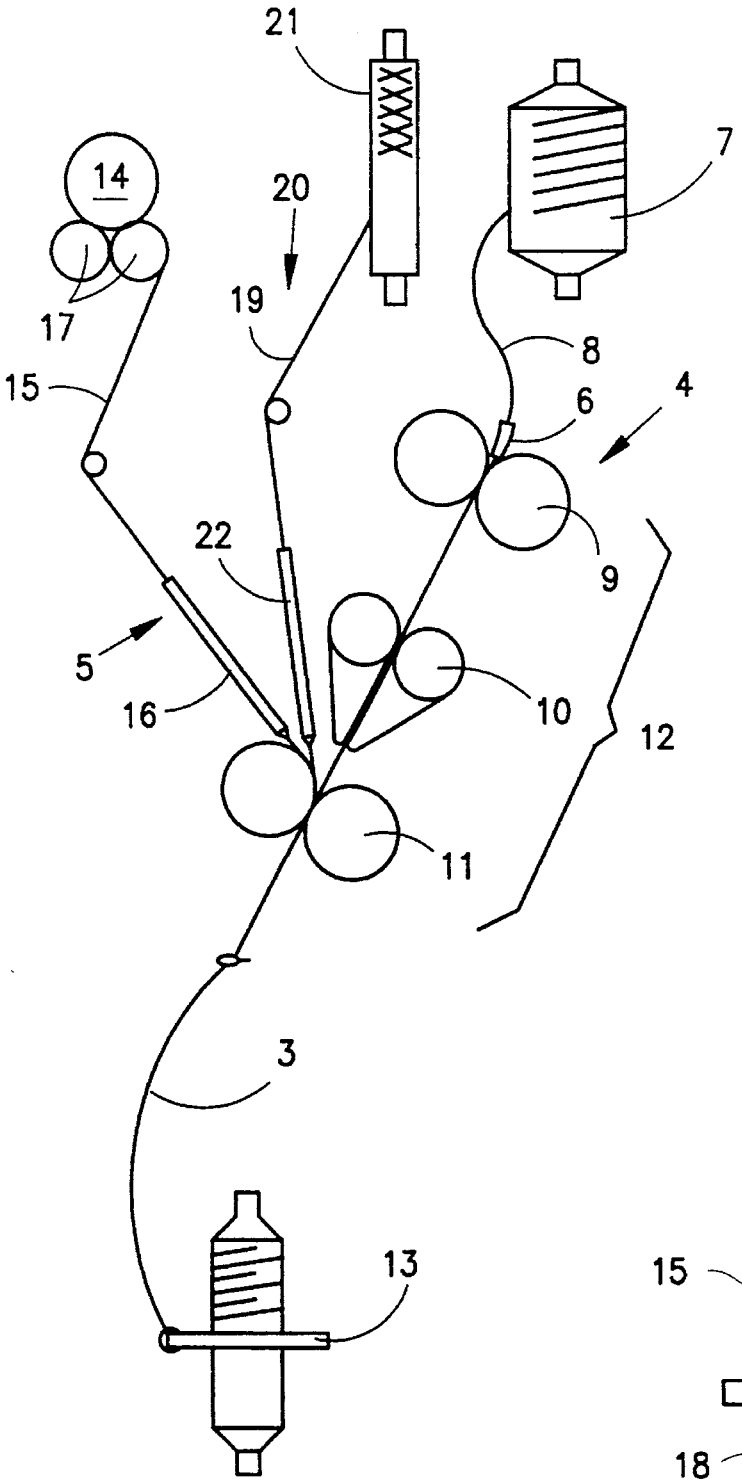
FIG. 2A is a schematic side view showing an apparatus for manufacturing spun core yarn according to a second embodiment of the present invention.
Figure 2B:
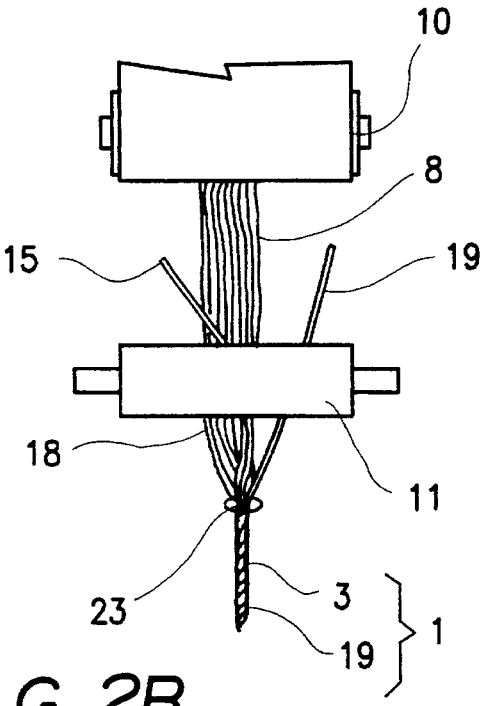
FIG. 2B is a plan view of a front roller pair portion of the apparatus of FIG. 2A.

An example of the manufacturing apparatus is shown in FIGS. 2A and 2B. The manufacturing apparatus is similar to that in the case of the first embodiment in that the apparatus in this embodiment is provided with a spinning device 4 and an elastic yarn feed device 5, but different in that the apparatus in this embodiment is additionally provided with a feed device 20 for feeding heat fusible yarn 19. Being the same as those in the case of the first embodiment, the parts of the spinning device 4 and the elastic yarn feed device 5 are correspondingly referenced and the explanation thereof is omitted here. The heat fusible yarn feed device 20 is provided with a tubular guide 22 so that the tubular guide 22 introduces the heat fusible yarn 19 from a heat fusible yarn package 21 into a nip portion between the pair of front rollers 11 at the upstream side of the front roller pair 11. That is, although the tubular guide 16 is arranged so that the elastic yarn 15 is fed into the central portion of the roving 8 drafted to be belt-like, the tubular guide 22 is arranged so that the feed point of the heat fusible yarn 19 is displaced toward the end side of the front roller pair 11 from the feed point of the elastic yarn 15 to thereby make it possible that the heat fusible yarn 19 is fed to a position separated from the position where the belt-like roving 8 and the elastic yarn 15 are put on each other.

The fusible adhesive yarn 1 can be obtained by using the above apparatus in a manner as follows. Similarly to the case of the first embodiment, the roving 8 drawn out from the roving bobbin 7 is drafted through the draft part 12. When the roving 8 made to be belt-like is nipped by the front roller pair 11, the elastic yarn 15 in the suitably stretched state is fed into the central portion of the belt-like roving 8 from the upstream side of the nipping point. When the roving 8 is passed through the nipping point together with the elastic yarn 15, the belt-like roving 8 encloses the elastic yarn 15 by the propagation of twisting toward the upstream side by the twisting by means of the twisting portion 13 so that core yarn is formed with the elastic yarn 15 as a core and with the short fiber assembly 18 constituting the roving 8 as a sheath around the circumference of the core elastic yarn 15. Before and after the formation of the core yarn, the heat fusible yarn 19 fed through the tubular guide 22 into another nipping point of the front roller pair 11 separated from the belt-like roving 8 and on the upstream side of a twisting point 23 passes this other nipping point and comes into contact with the above-mentioned core yarn so as to be twisted with the core yarn at the twisting point 23. Accordingly, in the case of this yarn, the twisting direction is the same between the core yarn and the heat fusible yarn 19.

A specific example of the fusible adhesive yarn in this embodiment will be described under.

When spun core yarn was spun out with 210 D polyurethane elastic yarn (melting point in the range of about 150°~230° C.) as core yarn and with 3 D, average fiber length 105 m/m, 100% acrylic dyed staple fiber as a short fiber assembly of the sheath portion, the above spun core yarn and 100 D polyamide multi-filament heat fusible yarn were parallelly fed and 700 T/M twisted with each other in the Z-direction so that M/C, 1/12 fusible adhesive yarn according to the present invention was obtained. The fuse-adhesive force of the thus prepared yarn was 380 g and was sufficient to show the effect in preventing fraying from occurring.

Figure 4:
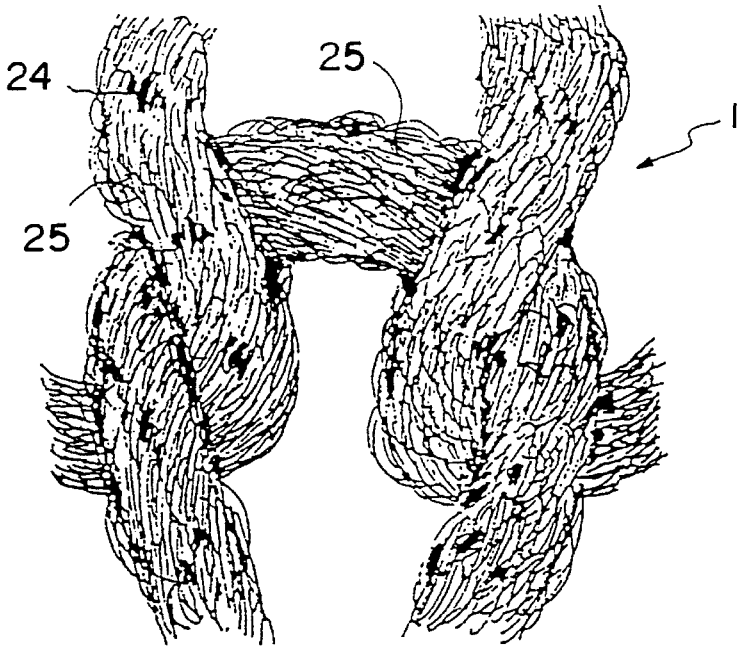
FIG. 4 is a front view showing knitted loops with the fusible adhesive yarn after heating according to the present invention.
Figure 5:
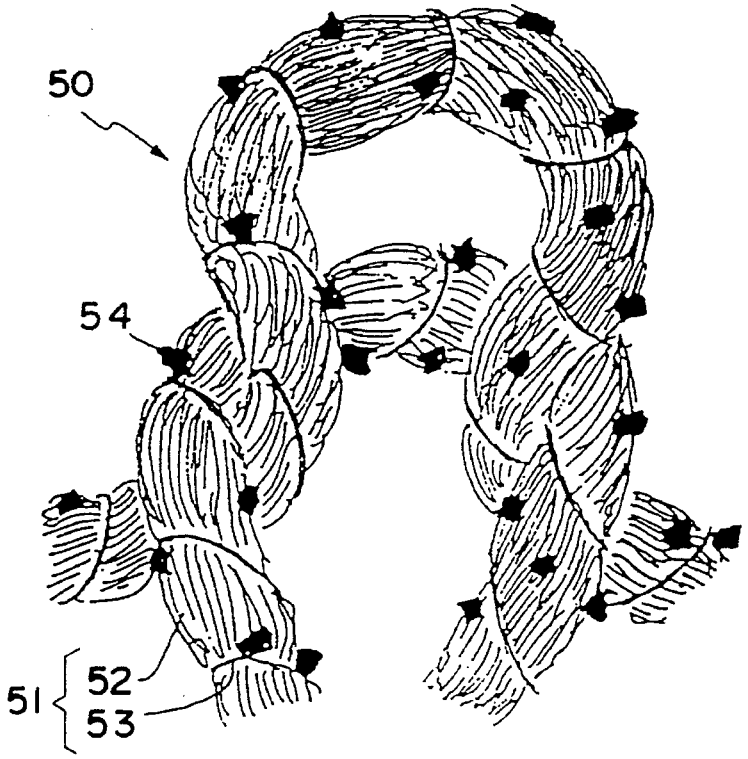
FIG. 5 (PRIOR ART)
FIG. 5 is a front view showing knitted loops with conventional fusible adhesive yarn after heating.

As the above heat fusible yarn, known are polyamide multi-filaments (for example, "Flor" produced by UNITIKA, Ltd.; "Elder" produced by TORAY INDUSTRIAL INC.; etc.; melting point in the range of about 110°–130° C.). Polyolefin monofilament may be used in place of the above polyamide multi-filaments. When prevention of fraying at edges of knitting fabric is carried out by using the fusible adhesive yarn of the first or second embodiment, the fusible adhesive yarn is knitted into several courses including the final course of the knitting fabric and then the knitting fabric is thermally set after completion of knitting. Thus, the heat fusible yarn in the knitted fusible adhesive yarn is fused so as to gather at positions in dots and the elastic yarn contracts. As shown in FIG. 4, the short fiber assembly 18 in the sheath portion located around the elastic yarn is expanded and bent by the contraction of the elastic yarn, and the fusible adhesive yarn attached on the short fibers is solidified into small blocks 24 located in the form of dots so that the expanded short fibers 25 cover the small blocks 24. Thus, at least the small blocks 24 caused by the fused heat fusible yarn and located on the surface of the knitting fabric are hardly touched directly by the skin, body or the like, owing to the expanded short fibers 25.

As the short fibers at the sheath portion used in the fusible adhesive yarn according to the present invention, various kinds of natural or man-made fibers, which can be spun, are used individually or in the form of mixed fibers in accordance with the purpose of use.

By the above structure, the fusible adhesive yarn according to the present invention shows an excellent effect that the knitting fabric is excellent in feeling and touch because the fused heat fusible yarn hardly appears on the surface of the knitting fabric, and that the heat fuse adhesive force is large to make it possible to obtain knitting fabric edges in which fraying hardly occurs.

What is claimed is:

1. Fusible adhesive yarn comprising spun core yarn having a melting point of about 150°~230° C. and heat fusible yarn wrapped about the spun core yarn having a melting point about 110°~130° C., said spun core yarn including elastic yarn and non-elastic short fiber assembly extending in the direction of said elastic yarn so that said non-elastic short fiber assembly encloses the circumference of said elastic yarn as a core, and wherein the elastic yarn is in a relaxably tensioned state due to a tensioned extension applied thereto during wrapping of the heat fusible yarn about the spun core yarn, the elastic yarn in said tensioned state forming a means for loosening the short fiber assembly via expansion and bending thereof by contraction of said elastic yarn due to a relaxation of the tensioned extension of the elastic yarn, in a manner providing air gaps therein into which dots of the heat fusible yarn, created upon thermal setting thereof, can enter so as to be substantially covered by the short fiber assembly.

2. The fusible adhesive yarn according to claim 1, wherein said spun core yarn is twisted and a wrapping direction of said heat fusible yarn about the spun core yarn is in a direction opposite to the twisting of said spun core yarn.

3. The fusible adhesive yarn according to claim 1, wherein said spun core yarn is twisted and a wrapping direction of said heat fusible yarn about the twisted spun core yarn is the same as the twisting direction of said spun core yarn.

4. The fusible adhesive yarn according to claim 1, wherein said non-elastic short fiber assembly is made of dyed staple fiber.

5. The fusible adhesive yarn according to claim 1, wherein said heat fusible yarn is made of one of polyamide multifilaments and polyolefin monofilament.

6. Fusible adhesive yarn comprising spun core yarn having a melting point of about 150°~230° C. and heat fusible yarn wrapped about the spun core yarn having a melting point about 110°~130° C., said spun core yarn including elastic yarn and non-elastic short fiber assembly extending in the direction of said elastic yarn so that said non-elastic short fiber assembly encloses the circumference of said elastic yarn as a core, wherein the elastic yarn is in a relaxably tensioned state due to a tensioned extension applied thereto, the elastic yarn in said tensioned state forming a means for loosening the short fiber assembly via expansion and bending thereof by contraction of said elastic yarn due to a relaxation of the tensioned extension of the elastic yarn, in a manner providing air gaps therein into which dots of the heat fusible yarn, created upon thermal setting thereof, can enter so as to be substantially covered by the short fiber assembly; and wherein said spun core yarn is twisted and a wrapping direction of said heat fusible yarn about the twisted spun core yarn is the same as the twisting direction of said spun core yarn.

7. Fabric formed of several courses of knitted fusible adhesive yarn, said fusible adhesive yarn comprising spun core yarn having a melting point of about 150°~230° C. and heat fusible yarn having a melting point about 110°~130° C. wrapped about the spun core yarn with a tensioned extension having been applied to the elastic yarn, said spun core yarn including elastic yarn and non-elastic short fiber assembly extending in the direction of said elastic yarn so that said non-elastic short fiber assembly encloses the circumference of said elastic yarn as a core; wherein the knitted fabric has been thermally set with the fusible adhesive yarn fused as dots within and substantially covered by the short fiber assembly, the short fiber assembly having been loosened, by having been expanded and bent by contraction of said elastic yarn by contraction of said elastic yarn due to a relaxation of the tensioned extension thereof, in a manner forming air gaps therein into which the dots entered.

* * * * *